US011705262B2

(12) United States Patent
Klotz et al.

(10) Patent No.: US 11,705,262 B2
(45) Date of Patent: Jul. 18, 2023

(54) ELECTROMAGNETIC ACTUATING DEVICE WITH ADAPTABLE PLUNGER ARRANGEMENT

(71) Applicant: ETO Magnetic GmbH, Stockach (DE)

(72) Inventors: Alexander Klotz, Markdorf (DE); Timo Rigling, Moos (DE); Sebastian Bölling, Oberuhldingen (DE)

(73) Assignee: ETO Magnetic GmbH, Stockach (DE)

( * ) Notice: Subject to any disclaimer, the term of this patent is extended or adjusted under 35 U.S.C. 154(b) by 97 days.

(21) Appl. No.: 17/415,891

(22) PCT Filed: Feb. 11, 2020

(86) PCT No.: PCT/EP2020/053476

§ 371 (c)(1),
(2) Date: Jun. 18, 2021

(87) PCT Pub. No.: WO2020/182390

PCT Pub. Date: Sep. 17, 2020

(65) Prior Publication Data

US 2022/0068534 A1 Mar. 3, 2022

(30) Foreign Application Priority Data

Mar. 8, 2019 (DE) ..... 10 2019 105 938.0

(51) Int. Cl.
*H01F 7/122* (2006.01)
*H01F 7/16* (2006.01)
*H01F 7/126* (2006.01)

(52) U.S. Cl.
CPC ..... *H01F 7/122* (2013.01); *H01F 7/126* (2013.01); *H01F 7/1638* (2013.01); *H01F 2007/163* (2013.01); *H01F 2007/1692* (2013.01)

(58) Field of Classification Search
CPC ..... H01F 7/122; H01F 7/126; H01F 7/1638; H01F 2007/163; H01F 2007/1692; F01L 2013/0052; F01L 2013/101; F01L 2301/00
See application file for complete search history.

(56) References Cited

U.S. PATENT DOCUMENTS 4,635,683 A * 1/1987 Nielsen ..... H01F 7/1638 251/129.08
5,829,122 A * 11/1998 Keuerleber ..... H01F 7/081 239/585.5

(Continued)

FOREIGN PATENT DOCUMENTS

DE 20114466 U1 1/2002
DE 102013108027 A1 1/2015

(Continued)

OTHER PUBLICATIONS

Machine translation of Bergfeld, Jan. 2016, DE-102014109634-A1 (Year: 2016).*

(Continued)

*Primary Examiner* — Bernard Rojas
(74) *Attorney, Agent, or Firm* — Bachman & LaPointe, P.C.

(57) ABSTRACT

The invention relates to an electromagnetic actuating device (20) having at least two actuator units (1a, 1b) which are arranged adjacently in a housing (10) and which each have electrically energizable static coil means (2a, 2b), armature means (3a, 3b) mounted so as to be movable relative to said coil means, and a plunger (4a, 4b) which interacts with the armature means (3a, 3b) and which is mounted so as to be movable along axial plunger direction (S1, S2) and which has a free end portion (5a, 5*b*) for engagement into an actuation partner, in particular a guide groove of a camshaft, wherein the plungers (4*a*, 4*b*) of the actuator units (1*a*, 1*b*)

(Continued)

of the actuating device (20) are preferably arranged such that the plunger directions (S1, S2) thereof run parallel to one another, and wherein the device (20) has adjustment means (6) which are integrated in the housing (10) and which serve for varying the arrangement of at least one plunger along a plane (E) perpendicular to the respective plunger direction (S1, S2).

18 Claims, 6 Drawing Sheets

(56) References Cited

U.S. PATENT DOCUMENTS

2016/0071640 A1* 3/2016 Kato ..... H01F 7/1615 335/229

2016/0125990 A1* 5/2016 Strigerwald ..... H01F 7/17 335/229

FOREIGN PATENT DOCUMENTS

| | | | | |
|---|---|---|---|---|
| DE | 102014109634 | A1 * | 1/2016 | ..... H01F 7/122 |
| DE | 102016100417 | A1 | 7/2016 | |
| DE | 102016123571 | A1 | 10/2017 | |
| DE | 102017114246 | A1 | 1/2019 | |
| JP | 2017078338 | A | 4/2017 | |
| WO | 2017179100 | A1 | 10/2017 | |

OTHER PUBLICATIONS

International search report for patent application No. PCT/EP2020/053476 dated Apr. 17, 2020.

* cited by examiner

A-A
B-B
C-C

ELECTROMAGNETIC ACTUATING DEVICE WITH ADAPTABLE PLUNGER ARRANGEMENT

BACKGROUND OF THE INVENTION

The present invention relates to an electromagnetic positioning device. In particular, the present invention relates to an electromagnetic positioning device comprising at least two actuator units and adjustment means for changing the relative plunger positioning of the actuator units.

Electromagnetic positioning devices as actuators for different positioning functions in the motor vehicle field are well known from the state in the art. As shown in DE 20 114 466 U1, for example, said electromagnetic positioning devices generally comprise energizable stationary coil means, armature means which are mounted so as to be movable in relation to the coil means and a plunger which interacts with the armature means and which is mounted so as to be movable along an axial plunger direction and which can be driven along the plunger direction and can be moved out of the actuator housing in response to an energization of the coil means.

Such actuators are used, in particular, for adjusting the camshaft of a combustion engine, wherein, in order obtain short switching times whilst enabling cost-effective series production, it has proven advantageous for such actuators to be provided with permanent magnets on the side of the armature, said permanent magnets interacting in a repelling manner with the energized coil means. However, at least two actuators to be provided adjacent to one another are normally required, especially if the actuators are used for adjusting the camshaft, in particular in order to realize different positions of the camshaft by two adjacent plungers of the actuators.

It is therefore known from the state of the art to arrange two separate actuators adjacent to one another and to operate said actuators in a suitable manner so that the plungers engage into the camshaft. However, this causes additional complexity concerning the electrical connection and concerning the installation of the individual actuators. Additionally, relatively small plunger distances cannot be obtained because of a required minimum housing width which is caused by the radial extension of the coil means arranged therein. Furthermore, it is known to arrange two adjacent plungers which can be individually controlled in a common housing. However, such an arrangement is problematic in view of inevitable installation or operation tolerances on a motor vehicle combustion engine, because no tolerance compensation can be realized because of the plural plunger guiding in a single housing. Additionally, such a configuration is normally made specifically for an interaction with a specific, predefined positioning partner, such as a specific camshaft guide, and the usability or use is thus very limited.

SUMMARY OF THE INVENTION

The object of the present invention is to overcome or at least significantly reduce the aforementioned disadvantages of the state of the art. In particular, an improved electromagnetic positioning device is to be provided, said positioning device enabling an optimized adaptability with respect to installation or fitting tolerances at the installation site whilst enabling a space-saving configuration and low manufacturing expenses. Said object is attained by the subject matter of the independent claims. Advantageous embodiments of the present invention are disclosed in the dependent claims.

In a first aspect, the invention relates to an electromagnetic positioning device comprising at least two actuator units arranged adjacent to one another in a housing, the actuator units each comprising energizable stationary coil means, armature means mounted so as to be movable in relation to the coil means, and a plunger interacting with the armature means and mounted so as to be movable along an axial plunger direction and having a free end section for engaging into a positioning partner, in particular a guide groove of a camshaft, the plungers of the actuator units of the positioning device preferably being arranged in such a manner that their plunger directions run parallel to one another, and the device comprising adjustment means integrated into the housing for changing the arrangement of at least one plunger along a plane perpendicular to the respective plunger direction.

This means in particular that an arrangement or positioning of the respective plunger can be adjusted or adapted by the adjustment means. The plane which is perpendicular to the plunger direction refers to a plane which is perpendicular to the respective axial plunger direction and therefore extends radially thereto. The adjustment means are in particular supposed to enable an adjustment of the respective plunger arrangement along or parallel to the described plane and therefore in a radially flexible manner.

The device according to the invention allows the plungers of the adjacent actuator units of the positioning device to be variably positioned relative to each another in contrast to the state of the art whilst maintaining the preferably axially parallel orientation of the plungers or of the plunger directions. As a result, the device is not only configured so as to be adaptable with respect to installation or operation tolerances, but can also be used for different purposes and is adjustable with respect to an engagement into different positioning partners. The present device can in particular be adapted to guide grooves of camshafts which are configured in different manners. The single-housing configuration of the device simultaneously enables simplified component handling and simplified installation of the positioning device in a combustion engine, for example. Furthermore, increased vibration stiffness is achieved by the single-housing configuration.

The arrangement or positioning of the respective plunger or of the respective plungers relative to one another, in particular with respect to their relative radial position, is preferably determined when the electromagnetic positioning device is being installed or in the installed state of the device. The arrangement of the plungers is determined either by a corresponding positioning partner itself or by guide means upstream of said positioning partner, for example a guide or installation plate which comprises predefined fitting bores.

The adjustment means according to the invention for changing the arrangement of a plunger along a plane perpendicular to the corresponding plunger direction can also be used in an alternative electromagnetic positioning device which comprises only a single actuator unit.

The respective plungers of the actuator units of the device can preferably at least be moved into a retracted state and an extended state in a selective manner along the respective axial plunger direction by interacting with the associated armature and coil means. In a preferred embodiment, the adjustment means are configured in such a manner that they enable a change in the relative arrangement of the plungers with respect to each other independent of a relative arrangement of the respective associated armature means and/or coil means. This means that a change in the relative plunger arrangement of the device in a plane perpendicular to the plunger direction is preferably not accompanied by a change in the relative arrangement of the armature and/or coil means, in particular not in a plane perpendicular to the plunger direction.

The respective coil means of the individual actuator units are preferably arranged statically in the housing, i.e., unchangeable in their position with respect to each other and/or to the housing. The respective armature means of the individual actuator units are preferably arranged unchangeable with respect to each other at least in a direction perpendicular to the plunger direction. This means that the armature means are arranged so as to be movable along their longitudinal axis with respect to the associated coil means, but a radial distance between the individual armature means of the device is preferably unchangeable and is thus permanently defined. In an alternative embodiment, the respective armature means of the device can be arranged or mounted in such a manner that they are variable with respect to each other in a direction perpendicular to the plunger direction.

In a preferred embodiment, the adjustment means are configured in such a manner that they enable a change in an axial distance d of adjacent plungers to one another and/or a change in the preferably radial position of at least one respective plunger relative to the respective other, in particular adjacent, plunger or relative to the housing of the device. The latter means that in top view or bottom view of the housing along the plunger direction a positioning of the respective plunger which is preferably radial to the plunger direction can be changed. Depending on the specific configuration of the adjustment means, said change can be accompanied by a change in the axial distance of the plungers.

The adjustment means are preferably configured in such a manner they enable a change in the axial distance d and/or in the relative position of adjacent plungers with respect to each other independent of an axial distance and/or of the relative position of respective longitudinal axes of the respective associated coil means and/or of the respective associated armature means.

In a preferred embodiment, the adjustment means are configured in such a manner that they enable a movement of at least one plunger in relation to another plunger in a direction which is perpendicular to the respective plunger direction. In an additional preferred embodiment, the adjustment means enable a relative movement of both or of several plungers of the device with respect to each other. The individual plungers can be arranged so as to be movable with respect to each other in an identical manner and/or in a different manner by the adjustment means.

A preferred axial distance of the adjacent plungers of the device is between 10 mm to 30 mm, more preferably between 15 mm and 25 mm. The adjustment means preferably enable a change or shift of the respective plunger position by up to 5 mm, more preferably by up to 10 mm and most preferably by up to 15 mm, in a direction perpendicular to the respective plunger direction. This enables a particularly flexible adaptability to different purposes and positioning partners. If the device is merely used to compensate for tolerances, the adjustment means preferably enable a change or shift of the respective plunger position by up to 0.15 mm, more preferably by up to 0.3 mm, and most preferably by up to 0.5 mm, in a direction perpendicular to the respective plunger direction.

In a preferred embodiment, the respective plunger of the actuator unit is mounted in the housing by means of a provided plunger guide. The plunger guide is preferably an essentially cylindrical component in which the plunger is mounted or guided axially displaceable in the respective plunger direction. The guide is preferably arranged on the housing in such a manner that it is immobile in the axial plunger direction and can at least partially protrude from a base body of the housing. For example, the guide can comprise two internal bearing points for mounting or guiding the plunger. Alternatively, the plunger can simply be mounted or guided in a cylindrical bore of the guide.

In a preferred embodiment, the adjustment means comprise an adaptable or adjustable bearing of at least one plunger of an actuator unit in the housing of the device. For example, the adaptable bearing can be a direct bearing of the plunger or of a component connected to the plunger, such as the plunger guide described above, in which the plunger can be mounted axially displaceable.

In a preferred embodiment, the adjustment means comprise at least one groove-shaped recess for a displaceable bearing of a plunger or of a plunger guide receiving the plunger. The groove-shaped recess is preferably arranged in a bottom plate of the housing. Said bottom plate can be configured integrally with the housing or as a separate component, for example in the form of a separate flange plate, on the housing. The groove-shaped recess can be at least partially linear and/or curved. In another preferred embodiment, the groove-shaped recess can also be configured in the shape of a circle section and/or form a complex curve path. The groove-shaped recess preferably has a homogeneous width.

The adjustment means can comprise securing means by means of which the respective plunger and/or a plunger guide receiving the plunger is secured to the housing and, in particular, to the groove-shaped recess against loss. For example, the securing means can comprise a flange-like lock washer which is adapted to an outer diameter of the plunger guide and which can engage into or is guided in the groove-shaped recess. Alternative securing means can be realized by staking the individual components with respect to each other, the plunger or the guide receiving the plunger thus being secured to the housing.

According to a preferred embodiment, at least one plunger whose position can be changed by the adjustment means is axially decoupled from the associated armature means and/or the associated coil means. This means that the axial orientation of the plunger is not defined by the axial orientation of the associated stationary coil means and/or the axial orientation of the armature means. The respective plunger is preferably arranged or mounted displaceable in relation to the associated stationary coil means and/or the associated armature means of the respective actuator unit in a direction perpendicular to the respective axial extension, i.e., radially. The described axial decoupling can also be provided for both or several plungers of the device.

In a preferred embodiment, at least one of the plungers of the device, more preferably both or all plungers of the device, is/are arranged eccentrically in relation to the associated stationary coil means and/or the associated armature means of the respective actuator unit. This means that the respective plunger center axis is not arranged coaxially with the respective armature center axis or a coil center axis. An axial distance of the respective plungers is preferably smaller than an axial distance of the associated coil means and/or armature means.

In a preferred embodiment, the respective plunger is mounted displaceable by means of magnetic force on the armature means or on a so-called disc pack of the armature means or adheres thereto in a displaceable manner. For example, this can be realized by a magnetization of an end of the plunger which is assigned to the armature means and/or of the armature means or of the disc pack. The plunger is preferably arranged displaceable on the armature means in a direction which is perpendicular to the plunger direction.

In an alternative embodiment, the respective plunger is fixed to the associated armature means and the respective armature means are arranged or mounted in the housing displaceable in relation to the associated stationary coil means in a direction which is perpendicular to the plunger direction.

In a preferred embodiment, the positioning device comprises a common connector or plug unit for energizing the coil means of the actuator units. Said connector or plug unit is preferably made of polymer material. The connector or plug unit is preferably configured integrally on the housing, i.e., not as a separate component.

In an additional aspect, the invention relates to the use of the electromagnetic positioning device as described above for installation on a combustion engine of a motor vehicle in order to adjust its camshaft.

In order to determine the positioning of the plunger of the device in the installed state, the camshaft itself or a component upstream of the camshaft can be used, such as a separate guide plate which has predefined fitting bores through which the plungers and/or the plunger guides can be guided or mounted in positions which are radially fixed with respect to each other.

BRIEF DESCRIPTION OF THE DRAWINGS

Further advantages, features and details of the invention are apparent from the following description of preferred exemplary embodiments and from the figures. In the figures.

DETAILED DESCRIPTION

Figures 1A, 1B, 1C, 1D, 1E:
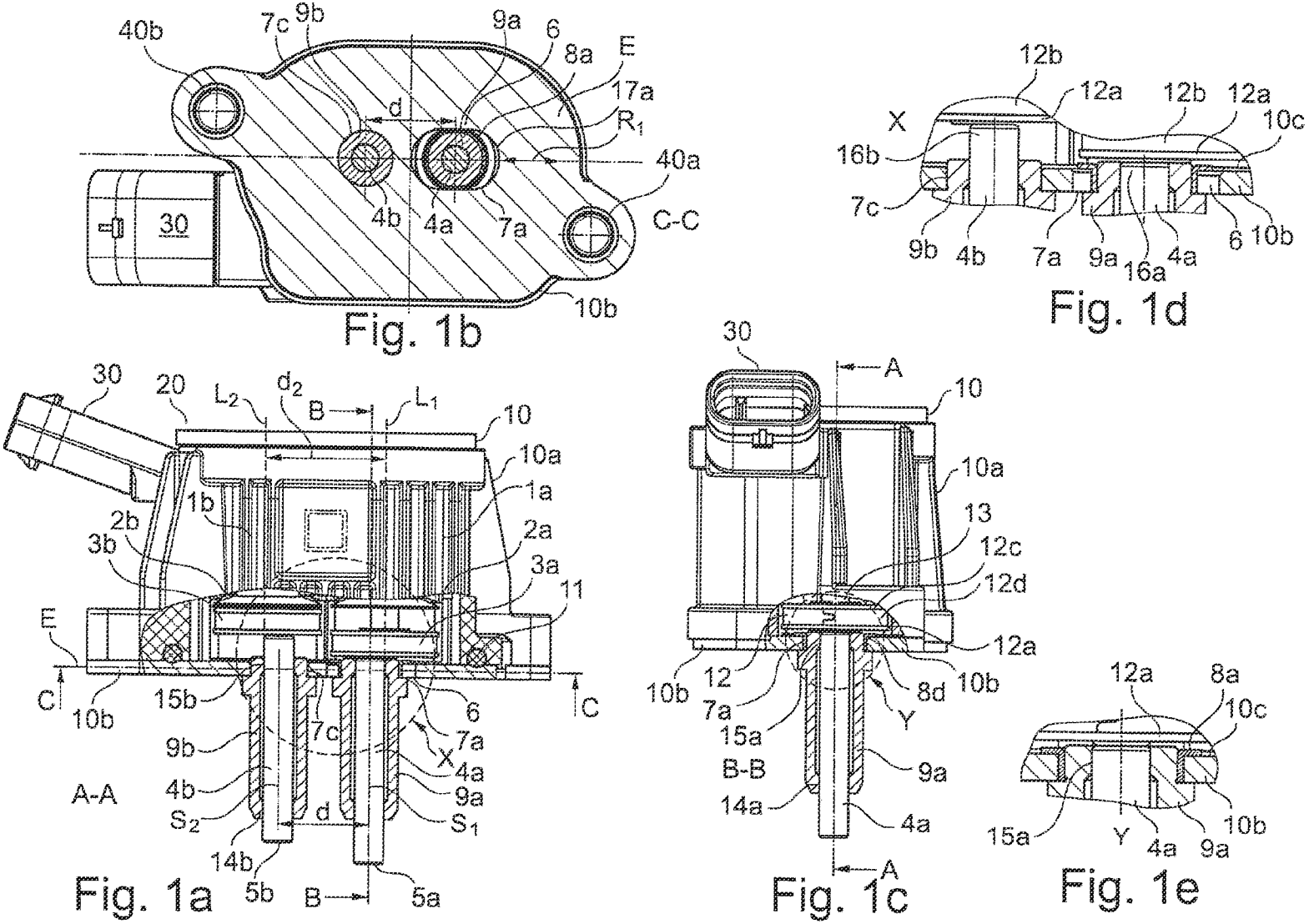
FIG. 1*a* is a front view of a positioning device according to the invention including a sectional view of the plunger.
FIG. 1*b* is a bottom view of the positioning device according to FIG. 1*a*.
FIG. 1*c* is a lateral view of the positioning device including a sectional view of an adaptable plunger.
FIG. 1*d* is a detailed view from FIG. 1*a* which shows the connection of the plunger and the armature means.
FIG. 1*e* is a detailed view from FIG. 1*c* which shows the connection of an adaptable plunger with the armature means.

In the figures, the same elements and elements having the same function are referenced with the same reference numerals.

FIGS. 1*a*-1*e* show different views of a first preferred exemplary embodiment of the positioning device according to the invention. Positioning device 20 shown in a lateral sectional view in FIG. 1*a* comprises two actuator units 1*a*, 1*b* which are adjacent to one another and which are arranged in a common housing 10. Housing 10 is preferably made of polymer material, for example by means of injection molding, and can be realized in one or several parts. In the present case, housing 10 comprises an essentially cylindrical base body 10*a* and a bottom plate 10*b* which can be fixed thereto on the bottom side. A seal 11, such as an O-ring, can be arranged between bottom plate 10*b* and housing base body 10*a*. Housing 10 preferably comprises only one common connector or plug unit 30 for energizing actuator units 1*a*, 1*b*. Connector or plug unit 30 is preferably integrally configured on the housing at a head end of base body 10*a* opposite to bottom plate 10*b*. The housing can comprise integrated fastening bores 40*a*, 40*b* for installation purposes.

Actuator units 1*a*, 1*b* each comprise coil means 2*a*, 2*b* which can be energized, which are arranged in a stationary manner in the housing and which are known from the state of the art, and armature means or an armature assembly 3*a*, 3*b* which can be moved relative to coil means 2*a*, 2*b* and which are also known from the state of the art. Armature assembly 3*a*, 3*b* can comprise several discs which are arranged coaxially, such as a base disc 12*a*, a permanent magnet disc (cf. 12*b* in FIG. 5*d*), a head disc 12*c* and an outer (retaining) ring 12*d*, which realize a so-called disc pack 12. In the shown exemplary embodiment, armature means 3*a*, 3*b* comprise a cylindrical extension 13 which extends coaxially from disc pack 12 at least partially through coil means 2*a*, 2*b*. Armature means 3*a*, 3*b* of individual actuator units 1*a*, 1*b* are therefore preferably arranged coaxially in relation to a center axis L1, L2 of respective associated coil means 2*a*, 2*b* and can be moved along respective axis L1, L2 by energizing associated coil means 2*a*, 2*b*.

Furthermore, positioning device 20 comprises plungers 4*a*, 4*b* which are assigned to respective actuator units 1*a*, 1*b* and which are configured to interact with respective associated armature means 3*a*, 3*b* in such a manner that a movement of armature means 3*a*, 3*b* and therefore a movement of plungers 4*a*, 4*b* along a respective axial plunger direction S1, S2 is realized by energizing respective coil means 2*a*, 2*b*. Plungers 4*a*, 4*b* or their respective plunger direction S1, S2 are preferably oriented axially parallel to one another. Actuator units 1*a*, 1*b* are configured in such a manner that plungers 4*a*, 4*b* can be selectively moved into at least one retracted state (cf. plunger 4*b* in FIG. 1*a*) and one extended state (cf. plunger 4*a* in FIG. 1*a*) by energizing respective coil means 2*a*, 2*b*.

Plungers 4*a*, 4*b* have a cylindrical shape and each comprise a free end section 5*a*, 5*b* which protrudes from housing 10 and which is configured to engage into a positioning partner, in particular a guide groove of a camshaft. Plungers 4*a*, 4*b* are preferably mounted in or on housing 10 by means of respective associated plunger guides 9*a*, 9*b*. Plunger guides 9*a*, 9*b* are preferably essentially cylindrical components in which plungers 4*a*, 4*b* are mounted or guided axially displaceable in respective plunger direction S1, S2. Guides 9*a*, 9*b* are preferably arranged on housing 10 in such a manner that they are immobile at least in axial plunger direction S1, S2. Guides 9*a*, 9*b* can comprise two internal bearing points 14*a*, 14*b* and 15*a*, 15*b* for mounting or guiding plunger 4*a*, 4*b*. Alternatively, plungers 4*a*, 4*b* can each be mounted or guided in a provided cylindrical bore of guides 9*a*, 9*b*.

In the shown exemplary embodiment, plungers 4*a*, 4*b* are axially decoupled from associated coil means 2*a*, 2*b* and associated armature means 3*a*, 3*b*. This means that the axial orientation of respective plunger 4*a*, 4*b* is not defined by the axial orientation of stationary coil means 2*a*, 2*b* and armature means 3*a*, 3*b*. In particular, the plungers which are axially movable along respective plunger direction S1, S2 are not arranged or oriented coaxially in relation to coil means 2*a*, 2*b* and armature means 3*a*, 3*b* which are arranged coaxially according to the present exemplary embodiment. In the present case, plungers 4*a*, 4*b* or their respective plunger direction S1, S2 are preferably arranged eccentrically in relation to center axis L1, L2 of coil means 2*a*, 2*b* (and armature means 3*a*, 3*b*). An axial distance d between plunger axes 4*a*, 4*b* is smaller than an axial distance d2 between center axes L1, L2 of coil means 2*a*, 2*b* and armature means 3*a*, 3*b*.

Plungers 4*a*, 4*b* are preferably connected to associated armature means 3*a*, 3*b* by means of magnetic force. As shown in FIG. 1*d*, for example, plungers 4*a*, 4*b* thus adhere to armature means 3*a*, 3*b* irrespective of the positioning of armature means 3*a*, 3*b*, i.e., both in the retracted and in the extended state. Plungers 4*a*, 4*b* adhere to respective base disc 12*a* of armature means 3*a*, 3*b*. This can be realized, for example, by a suitable magnetization of armature means 3*a*, 3*b* and/or of an end 16*a*, 16*b* of respective plunger 4*a*, 4*b* which is assigned to the armature means. By means of the magnetic connection between respective plunger 4*a*, 4*b* and associated armature means 3*a*, 3*b*, respective plunger 4*a*, 4*b* is arranged displaceable in relation to armature means 3*a*, 3*b* in at least one direction perpendicular to plunger direction S1, S2 and preferably radially flexible.

Furthermore, the device comprises adjustment means 6 which are integrated into the housing and which are configured in such a manner that they enable an adaption of the relative arrangement of plungers 4*a*, 4*b* with respect to each other in or parallel to a plane E perpendicular to a plunger direction S1, S2. Plane E, in which or along which plungers 4*a*, 4*b* can be changed with respect to their relative position with respect to each other by adjustment means 6, is preferably parallel to the extension of bottom plate 10*b* of housing 10. Adjustment means 6 enable a change or an adaption of the relative position of plungers 4*a*, 4*b* whilst maintaining the preferably axially parallel orientation of the plungers.

In the shown exemplary embodiment, adjustment means 6 comprise at least one adaptable bearing 17*a* of plunger 4*a* by means of which at least one of plungers 4*a* is arranged or mounted displaceable in housing 10. According to the present exemplary embodiment, adaptable bearing 17*a* comprises a groove-shaped, elongated recess 7*a* in bottom plate 10*b* of housing 10. Plunger 4*a*, together with plunger guide 9*a* receiving the plunger, is guided by elongated recess 7*a*. Adaptable bearing 17*a* preferably comprises securing means 8*a* which are configured to keep plunger 4*a* and/or plunger guide 9*a* receiving plunger 4*a* in a secured manner inside groove-shaped recess 7*a*. Securing means 8*a* can be a flange-like disc which is circumferentially adapted to plunger guide 7*a* and fixed thereto and which rests on an inner surface 10*c* of bottom plate 10*b*. An outer diameter of securing means 8*a* is preferably adapted to an inner diameter of groove-shaped recess 7*a* in such a manner that plunger 4*a* or plunger guide 9*a* can preferably still be displaced together with securing means 8*a* along groove-shaped recess 7*a* without great effort.

As shown in FIG. 1*b*, adjustment means 6 or groove-shaped recess 7*a* arranged in such a manner that it extends along a linear direction R1 which extends parallel to an axial distance d of the two plungers 4*a*, 4*b*. As described above, direction R1 is in (adjustment) plane E. By displacing plunger 4*a* inside linear recess 7*a* and therefore along direction R1, axial distance d between plungers 4*a* and 4*b* can be directly changed. The relative plunger position can thus be adapted to different positioning partners, in particular with respect to a distance between guide grooves into which the adjacent plungers are to engage. A securing against a (additional) change in the plunger position in the installed state of device 20 can be realized by the respective positioning partner and/or a guide plate (not shown) arranged upstream of the positioning partner, the guide plate guiding plungers 4*a*, 4*b* and/or plunger guides 9*a*, 9*b* in the installed state.

In the present exemplary embodiment, adjacent plunger 4*b* is fixed in its radial orientation, i.e., along plane E which is perpendicular to plunger direction S2. A plunger guide 9*b* of plunger 4*b* is arranged in a stationary manner, i.e., unchangeable, on the housing. As shown in FIGS. 1*a* and 1*b*, plunger guide 9*b* can be mounted in bottom plate 10*b* by means of a bore 7*c* which is adapted to the guide, for example. Alternatively, stationary guide 9*b* can be configured integrally with housing 10.

Aforementioned adjustment means 6 of positioning device 20 in particular also enable an adaption of the relative arrangement of plungers 4*a*, 4*b* irrespective of the stationary relative arrangement of corresponding armature means 3*a*, 3*b* and coil means 2*a*, 2*b*.

FIGS. 2*a*-2*e* show views analogous to FIGS. 1*a*-1*e* of another preferred embodiment of the positioning device according to the invention which comprises two adaptable plungers 4*a*, 4*b*. The basic structure of device 20 shown here corresponds to the structure according to FIGS. 1*a*-1*e*. Adjustment means 6 according to the present exemplary embodiment comprise two adaptable bearings 17*a*, 17*b* instead of one, by means of which the two plungers 4*a*, 4*b* of device 20 can be adjusted along plane E perpendicular to respective plunger direction S1, S2.

Figure 2D:
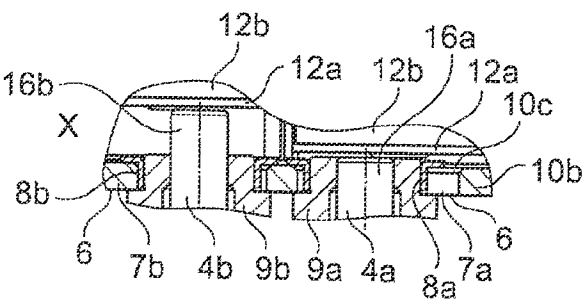
FIGS. 2*a*-2*e* are views analogous to FIGS. 1*a*-1*e* of another preferred embodiment of the positioning device according to the invention having two adaptable plungers.
Figure 2E:
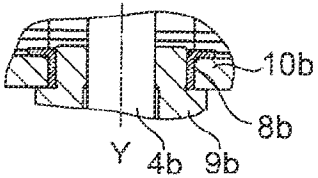
Figure 2C:
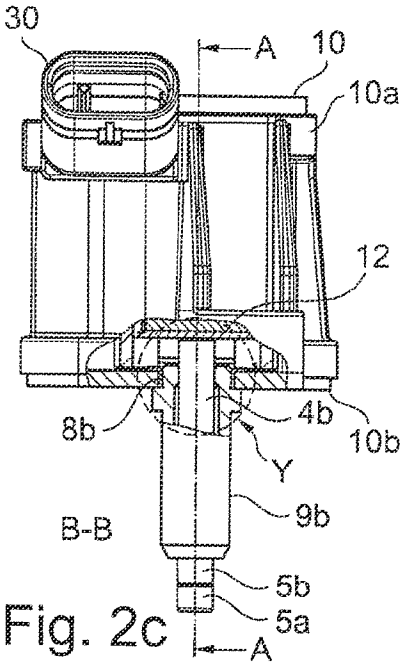
Figure 2B:
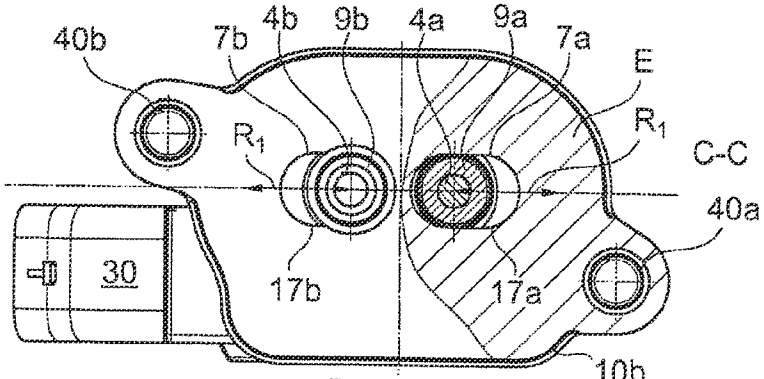
Figure 2A:
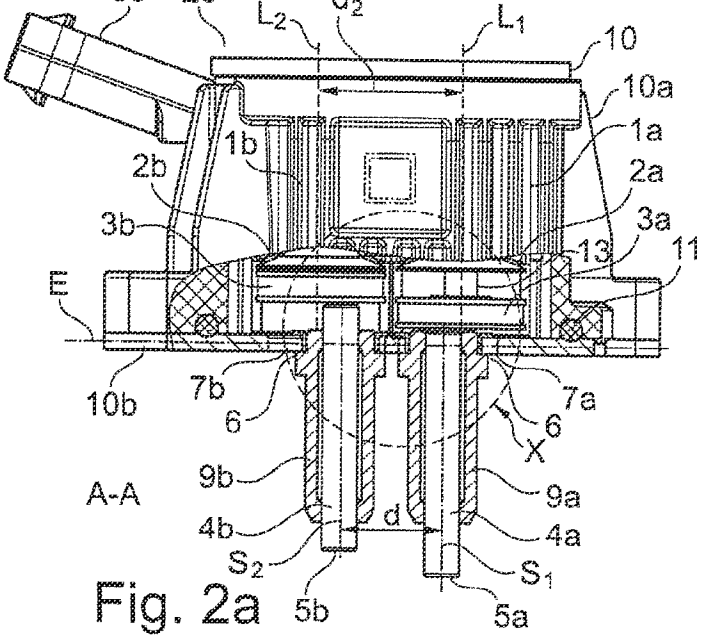
Figure 3D:
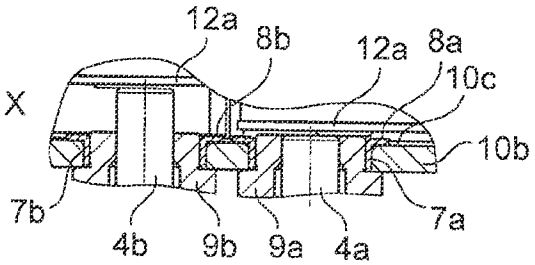
FIGS. 3*a*-3*e* are views analogous to FIGS. 2*a*-2*e* of another preferred embodiment of the positioning device according to the invention having two adaptable plungers and adjustment means arranged in an alternative manner.
Figure 3B:
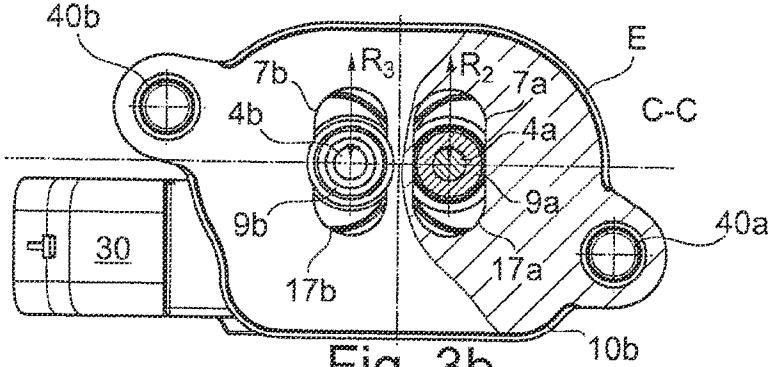
Figure 3E:
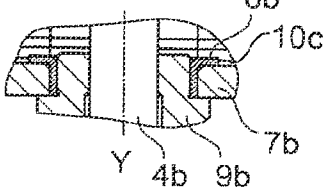
Figure 3C:
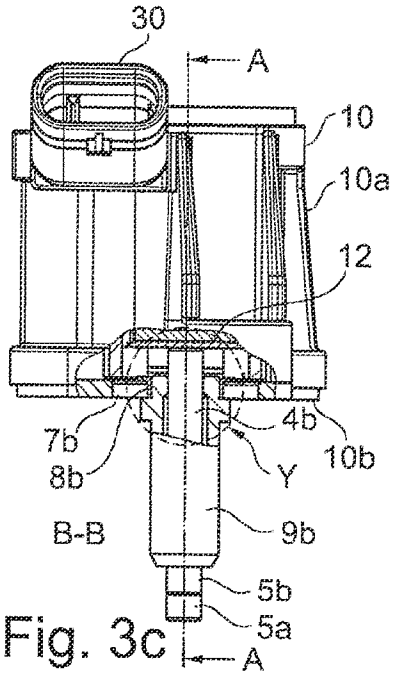
Figure 3A:
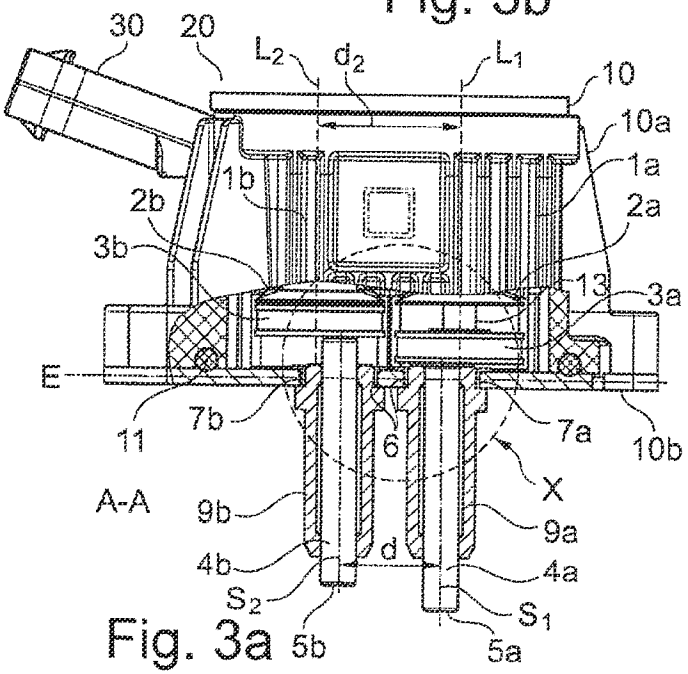
Figure 4D:
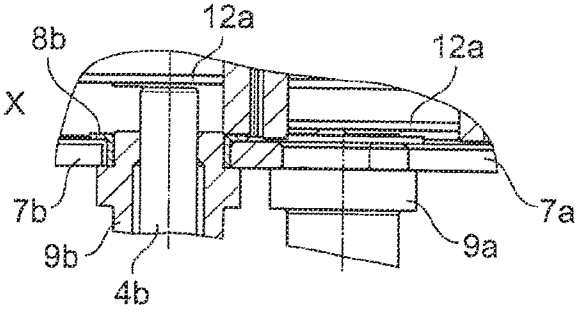
FIGS. 4*a*-4*d* are views analogous to FIGS. 3*a*-3*d* of another preferred embodiment of the positioning device according to the invention having two adaptable plungers and alternative adjustment means.
Figure 4C:
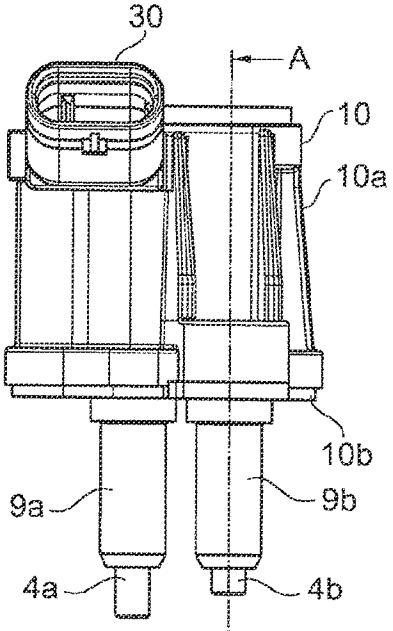
Figure 4B:
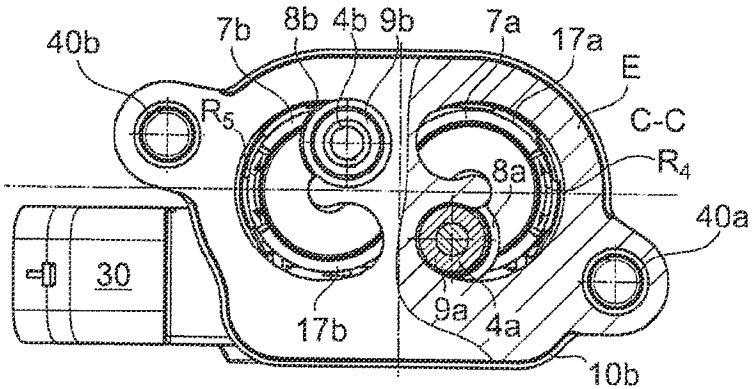
Figure 4A:
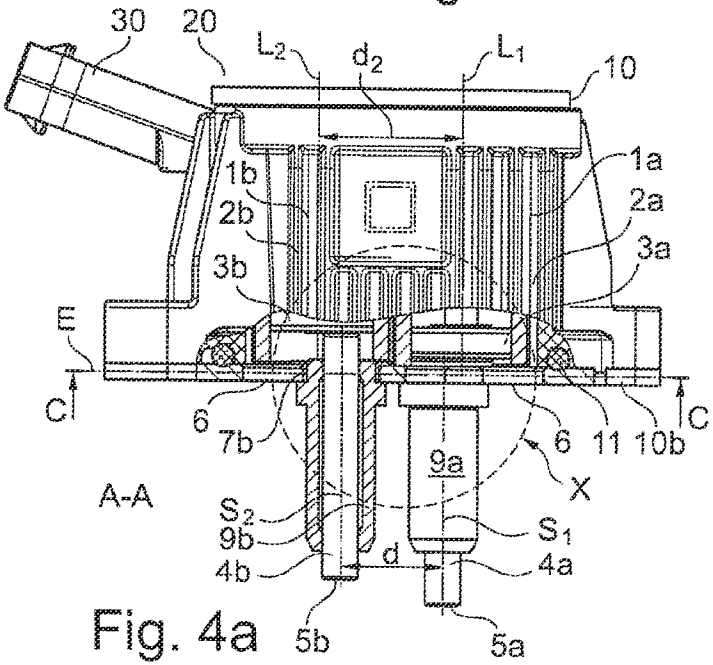

As shown in FIG. 2*b*, both adaptable bearings 17*a*, 17*b* comprise a groove-shaped recess 7*a*, 7*b*. As shown in the figure, said groove-shaped recesses 7*a*, 7*b* preferably extend in a collinear manner along direction R1 in (adjustment) plane E. Axial distance d between plungers 4*a*, 4*b* can thus be directly adjusted by means of each bearing 17*a*, 17*b*. The configuration of second bearing 17*b* of the adjustment means corresponds to first bearing 17*a* described with reference to FIGS. 1*a*-1*e*. In an alternative exemplary embodiment (not shown), groove-shaped recesses 7*a*, 7*b* can each extend parallel to shown direction R1 and therefore not in a collinear manner with respect to each other. In another alternative, groove-shaped recesses 7*a*, 7*b* can be arranged at an angle with respect to each other.

The positioning of plungers 4*a*, 4*b* relative to one another and/or relative to housing 20 can be adjusted in an even more optimal manner by such an exemplary embodiment.

FIGS. 3*a*-3*e* show views analogous to FIGS. 2*a*-2*e* of another preferred embodiment of the positioning device according to the invention which comprises two adaptable plungers. The basic structure of shown device 20 corresponds to the structure according to FIGS. 2*a*-2*e*.

In contrast to the preceding exemplary embodiment, groove-shaped recesses 7*a*, 7*b* are arranged parallel to one another in bottom plate 10*b* in a bottom view of housing 10. In particular, first groove-shaped recess 7*a* extends along a linear direction R2 and the second groove-shaped recess extends along a linear direction R3, both directions R2, R3 preferably both extending perpendicular to axial distance d of plungers 4*a*, 4*b* (in the shown bottom view of the housing according to FIG. 3*b*). Plungers 4*a*, 4*b* can therefore be optimally adapted to a positioning partner along parallel directions R2, R3. The plunger position on housing 10 can be adapted with and without a change in axial distance d between plungers 4*a*, 4*b*. In an alternative embodiment (not shown), directions R2, R3 can extend at an angle with respect to each other.

FIGS. 4*a*-4*d* show views analogous to FIGS. 3*a*-3*d* of another preferred embodiment of the positioning device according to the invention which comprises two adaptable plungers 4*a*, 4*b*. The basic structure of shown device 20 corresponds to the structure according to FIGS. 3*a*-3*d*.

In contrast to the preceding exemplary embodiment, adjustment means 6 or adaptable bearings 17*a*, 17*b* do not comprise linear, but curved groove-shaped recesses 7*a*, 7*b* by means of which respective plungers 4*a*, 4*b* are arranged displaceable perpendicular to plunger direction S1, S2 in (adjustment) plane E. In the bottom view shown in FIG. 4*b*, groove-shaped recesses 7*a*, 7*b* are arranged in the shape of a circle section in bottom plate 10*b* of housing 20. Plungers 4*a*, 4*b* are therefore arranged displaceable along circular directions R4 or R5 shown in the figure. As shown in the figure, shown groove-shaped recesses 7*a*, 7*b* can be arranged in such a manner that they mirror one another at an axis Z through bottom plate 10*b*. As an alternative to the shown configuration, groove-shaped recesses 7*a*, 7*b* can extend in a different manner with respect to each other and/or can realize more complex curve paths.

By means of the shown arrangement of adjustment means 6, the respective plunger position on housing 10 in (adjustment) plane E can be adjusted in an even more flexible manner.

Figure 5D:
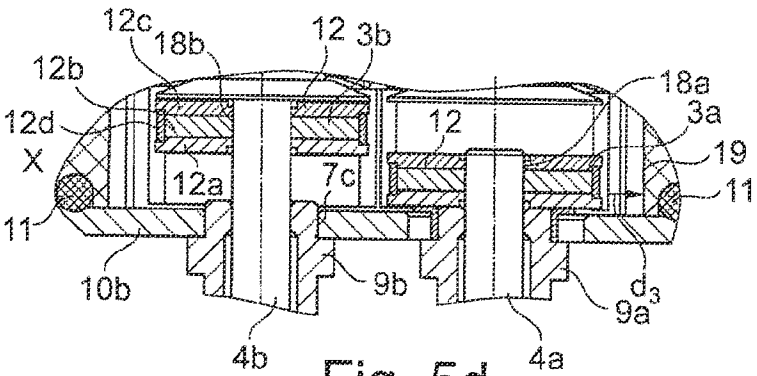
FIGS. 5*a*-5*e* are views analogous to FIGS. 1*a*-1*e* of another preferred embodiment of the positioning device according to the invention having an adaptable plunger and an alternative configuration of the armature means.
Figure 5B:
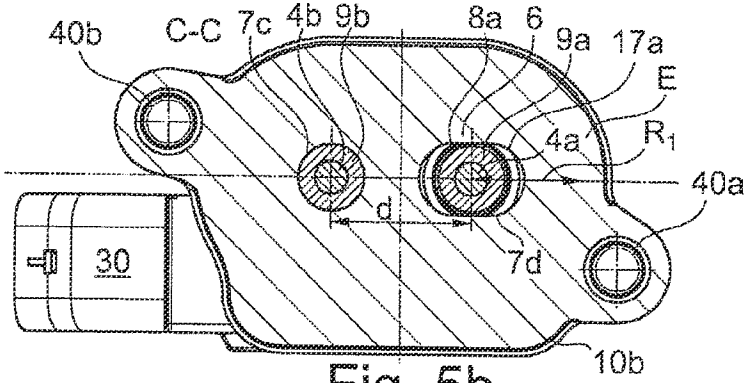
Figure 5A:
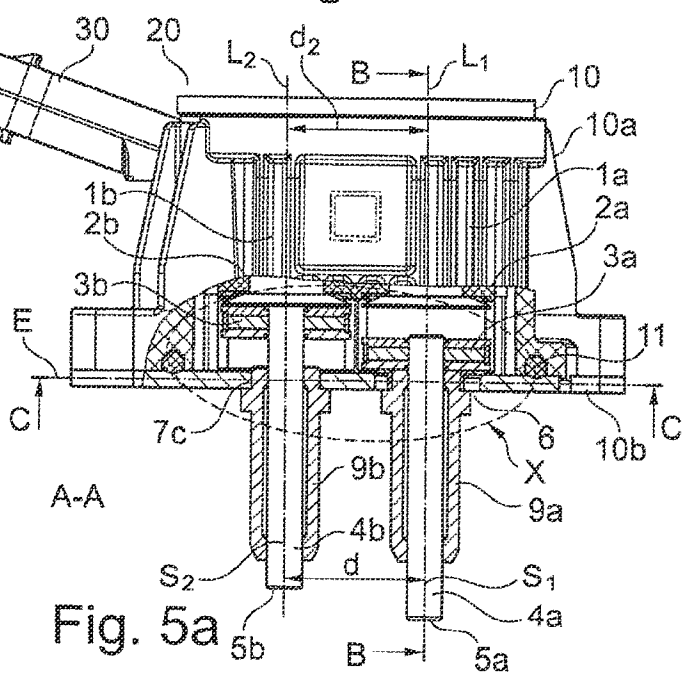
Figure 5C:
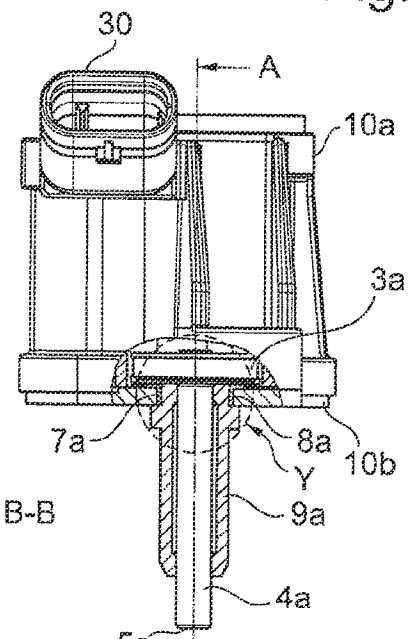
Figure 5E:
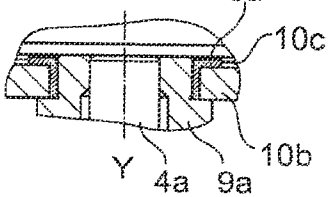

FIGS. 5*a*-5*e* show another preferred exemplary embodiment of the present invention. In contrast to the preceding exemplary embodiments, plungers 4*a*, 4*b* are fixed to associated armature means 3*a*, 3*b*. As shown in FIG. 5*d*, the fixation can be realized by means of a bore 18*a*, 18*b* in armature means 3*a*, 3*b* into which respective plunger 4*a*, 4*b* is fit or pressed. Alternatively, plunger 4*a*, 4*b* can be welded and/or glued to armature means 3*a*, 3*b* or to disc pack 12 of the armature means. Armature means 3*a*, 3*b* and corresponding plunger 4*a*, 4*b* are therefore preferably arranged concentrically with respect to each other.

According to said exemplary embodiment, an axial decoupling of armature means 3*a* from coil means 2*a* is preferably realized by omitting cylindrical extension 13 of armature means 3*a*, cylindrical extension 13 extending coaxially to the coil means (see FIG. 1*c*, for example). Armature means 3*a* are therefore not coupled to center axis L1 of the coil means with respect to their axial position, but can be moved, in particular in a perpendicular manner, relative to center axis L1 of the coil means. In order to guide armature means 3*a* in housing 10, a guide 19 enlarged in radial direction d3 compared to the preceding exemplary embodiments can be provided below and/or inside associated coil means 2*a* inside housing 10. Additionally, the axial guiding of armature means 3*a* is preferably realized via plunger guide 9*a* assigned to plunger 4*a*.

The remaining structure of positioning device 20 according to said exemplary embodiment corresponds to the exemplary embodiment according to FIGS. 1*a*-1*e*. In particular, adjustment means 6 of the device comprise an elongated groove-shaped recess 7*a* which extends parallel to axial distance d in a linear direction R1 in bottom plate 10*b* and in which the at least one adaptable plunger 4*a* is mounted.

In accordance with the preceding exemplary embodiments, the embodiment according to FIGS. 5*a*-5*e* can comprise adjustment means for both plungers 4*a*, 4*b*. In addition to the shown linear groove-shaped recess 7*a*, the adjustment means can also comprise one or several at least partially curved recesses or recesses which have a different shape.

Figure 6:
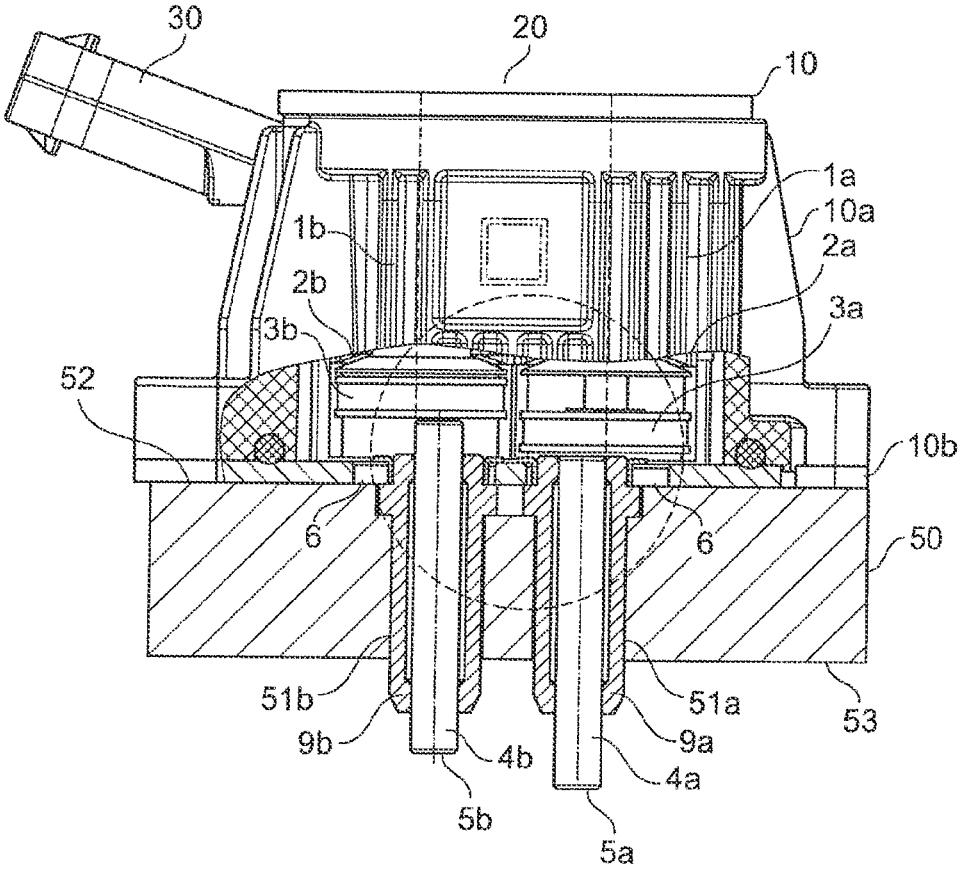
FIG. 6 is a lateral sectional view of the preferred embodiment of the positioning device according to FIGS. 2*a*-2*e* in the assembled state in a guide plate upstream of a positioning partner of the device.

FIG. 6 shows a lateral sectional view of the preferred embodiment of the positioning device according to FIGS. 2*a*-2*e* in the installed state in a guide or interface plate 50 upstream of the positioning partner of the device. Guide plate 50 preferably comprises two predefined fitting bores 51*a*, 51*b* which are adapted to the respective positioning partner, such as a camshaft (not shown) arranged below, i.e., to one or several guide grooves of the camshaft.

In the shown installed state of positioning device 20, the positioning of plungers 4*a*, 4*b* which has previously been adapted to guide plate 50 or fitting bores 51*a*, 51*b* arranged therein by means of arrangement means 6 according to the invention is now fixed. In particular, guides 9*a*, 9*b* and therefore plungers 4*a*, 4*b* mounted therein are no longer radially changeable in terms of their position with respect to each other because of predefined fitting bores 51*a*, 51*b*. A respective outer diameter of guides 9*a*, 9*b* can be adapted to the respective inner diameter of fitting bores 51*a*, 51*b*.

As shown, positioning device 20 can be installed and thus axially fixed on a plane surface 52 of guide plate 50, for example by means of fastening bores 40*a*, 40*b* described above. The thickness of guide plate 50 is preferably selected in such a manner that plungers 4*a*, 4*b* can protrude on a bottom side 53 opposite to surface 52, and that plungers 4*a*, 4*b* can selectively engage with a positioning partner arranged below by energizing associated coil means 2*a*, 2*b*.

As described above, positioning device 20 can be adapted to a predefined arrangement of fitting bores 51*a*, 51*b* with respect to the exact positioning of plungers 4*a*, 4*b* by means of adjustment means 6 according to the invention. In particular, tolerance compensation for predefined fitting bores 51*a*, 51*b* and therefore for a predefined positioning partner can be realized during installation and/or positioning device 20 can be adapted to different positioning partners or different interfaces.

The embodiments described above are only examples, the invention not being limited to the embodiments shown in the figures by any means. In particular, the shown embodiments can also be combined with one another. Furthermore, the adjustment means according to the invention for changing the arrangement of a plunger along a plane perpendicular to the corresponding plunger direction can also be used in an alternative electromagnetic positioning device which comprises only a single actuator unit.

The invention claimed is:

1. An electromagnetic positioning device (20) comprising at least two actuator units (1*a*, 1*b*) arranged adjacent to one another in a housing (10), the actuator units (1*a*, 1*b*) each comprising energizable stationary coil means (2*a*, 2*b*), armature means (3*a*, 3*b*) mounted so as to be movable in relation to the stationary coil means (2*a*, 2*b*), and a plunger (4*a*, 4*b*) interacting with the armature means (3*a*, 3*b*) and mounted so as to be movable along an axial plunger direction (S1, S2) and having a free end section (5*a*, 5*b*) for engaging into a positioning partner, and the device (20) comprising adjustment means (6) integrated into the housing (10) for changing the arrangement of at least one plunger along a plane (E) perpendicular to the respective plunger direction (S1, S2), wherein the adjustment means (6) are configured in such a manner that they enable a change in the relative arrangement of the plungers (4*a*, 4*b*) with respect to each other independent of a relative arrangement of the respective associated armature means (3*a*, 3*b*) and/or stationary coil means (2*a*, 2*b*).

2. The electromagnetic positioning device according to claim 1, wherein the adjustment means (6) are configured in such a manner that they enable a change in an axial distance (d) of the plungers (4*a*, 4*b*) to one another and/or a change in the position of at least one respective plunger (4*a*, 4*b*) relative to the respective other plunger (4*a*, 4*b*) and/or relative to the housing (10).

3. The electromagnetic positioning device according to claim 1, wherein the adjustment means (6) are configured in such a manner that they enable a movement of at least one plunger (4*a*, 4*b*) in relation to another plunger (4*a*, 4*b*) in a direction (R1, R2, R3, R4, R5) which is perpendicular to the respective plunger direction (S1, S2).

4. The electromagnetic positioning device according to claim 1, wherein the adjustment means (6) comprise an adaptable bearing (17*a*, 17*b*) of at least one plunger (4*a*, 4*b*) of an actuator unit (1*a*, 1*b*) in the housing (10) of the device (20).

5. The electromagnetic positioning device according to claim 1, wherein the adjustment means (6) comprise at least one groove-shaped recess (7*a*, 7*b*) for a displaceable bearing of a plunger (4*a*, 4*b*) inside a bottom plate (10*b*) of the housing (10).

6. The electromagnetic positioning device according to claim 5, wherein the groove-shaped recess (7*a*, 7*b*) is linear and/or curved.

7. The electromagnetic positioning device according to claim 1, wherein the adjustment means (6) comprise securing means (8*a*, 8*b*) by means of which a respective plunger (4*a*, 4*b*) and/or a plunger guide (9*a*, 9*b*) receiving the plunger is secured to the housing (10) of the positioning device (20).

8. The electromagnetic positioning device according to claim 1, wherein the plungers (4*a*, 4*b*) of the actuator units (1*a*, 1*b*) are arranged on the housing (10) by means of provided plunger guides (9*a*, 9*b*).

9. The electromagnetic positioning device according to claim 1, wherein at least one of the plungers (4*a*, 4*b*) is arranged so as to be changeable with respect to its radial position in relation to the stationary coil means (2*a*, 2*b*) and/or the armature means (3*a*, 3*b*) of the respective actuator unit (1*a*, 1*b*).

10. The electromagnetic positioning device according to claim 1, wherein at least one of the plungers (4*a*, 4*b*) is arranged eccentrically in relation to the stationary coil means (2*a*, 2*b*) and/or the armature means (3*a*, 3*b*) of the respective actuator unit (1*a*, 1*b*).

11. The electromagnetic positioning device according to claim 1, wherein at least one of the plungers (4*a*, 4*b*) is arranged displaceable by means of magnetic force on the armature means (3*a*, 3*b*) of the respective actuator unit (1*a*, 1*b*).

12. The electromagnetic positioning device according to claim 11, wherein the at least one of the plungers (4*a*, 4*b*) is arranged radially displaceable by means of magnetic force on the armature means (3*a*, 3*b*) of the respective actuator unit (1*a*, 1*b*).

13. The electromagnetic positioning device according to claim 1, wherein at least one of the plungers (4*a*, 4*b*) is fixed to the respective armature means (3*a*, 3*b*) and the respective armature means are arranged in the housing (10) displaceable in relation to the associated stationary coil means (2*a*, 2*b*).

14. The electromagnetic positioning device according to claim 13, wherein the respective armature means are arranged in the housing (10) radially displaceable in relation to the associated stationary coil means (2*a*, 2*b*).

15. The electromagnetic positioning device according to claim 1, wherein the positioning device (20) comprises a common connector or plug unit (30) for energizing the stationary coil means (2*a*, 2*b*) of the actuator units (1*a*, 1*b*).

16. A use of the electromagnetic positioning device (20) according to claim 1 for the installation on a combustion engine of a motor vehicle in order to adjust its camshaft.

17. The electromagnetic positioning device according to claim 1, wherein the plungers (4*a*, 4*b*) of the actuator units (1*a*, 1*b*) of the positioning device (20) are arranged in such a manner that their plunger directions (S1, S2) run parallel to one another.

18. The electromagnetic positioning device according to claim 1, wherein the positioning partner is a guide groove of a cam shaft.

* * * * *